US008567882B1

(12) United States Patent
Garnett

(10) Patent No.: US 8,567,882 B1
(45) Date of Patent: Oct. 29, 2013

(54) HEIGHT ADJUSTMENT MECHANISM FOR RACK ASSEMBLIES OF APPLIANCES

(71) Applicant: General Electric Company, Schenectady, NY (US)

(72) Inventor: William Nathan Garnett, Ekron, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/737,208

(22) Filed: Jan. 9, 2013

(51) Int. Cl.
*A47B 77/08* (2006.01)

(52) U.S. Cl.
USPC ..... 312/228.1; 312/351; 211/41.8

(58) Field of Classification Search
USPC ..... 312/228.1, 351, 319.1–319.2; 134/135; 211/41.3–41.4, 41.8–41.9, 126.15, 211/126.9, 133.5
See application file for complete search history.

(56) References Cited

U.S. PATENT DOCUMENTS 5,474,378 A 12/1995 Smith et al.
5,480,035 A * 1/1996 Smith ..... 211/41.8
5,657,878 A * 8/1997 Austin ..... 211/41.8
5,860,716 A 1/1999 Good et al.
7,418,967 B2 * 9/2008 Kim ..... 134/57 D
7,424,893 B2 9/2008 Kim
7,909,420 B2 * 3/2011 Jahrling ..... 312/228.1
8,192,557 B2 * 6/2012 Ryu et al. ..... 134/56 D
2003/0075517 A1 * 4/2003 Jahrling ..... 211/41.8
2004/0103932 A1 * 6/2004 Kim ..... 134/137
2005/0133469 A1 * 6/2005 Mersch et al. ..... 211/41.8
2006/0119236 A1 * 6/2006 Dickson et al. ..... 312/311
2006/0237042 A1 * 10/2006 Weaver et al. ..... 134/25.2
2008/0272072 A1 * 11/2008 Tynes et al. ..... 211/41.8
2009/0151758 A1 * 6/2009 Kristensson et al. ..... 134/201
2011/0017890 A1 * 1/2011 Ala ..... 248/235
2011/0018410 A1 * 1/2011 Bastuji et al. ..... 312/228.1

FOREIGN PATENT DOCUMENTS

EP 848930 A2 * 6/1998 ..... A47L 15/42
EP 1 166 708 A2 1/2002
WO WO 2010138262 A1 * 12/2010 ..... A47L 15/50

* cited by examiner

*Primary Examiner* — Hanh V Tran
(74) *Attorney, Agent, or Firm* — Dority & Manning, P.A.

(57) ABSTRACT

A rack assembly for an appliance is provided. The rack assembly includes a sidewall and a rack adjustment assembly. The rack adjustment assembly includes an engagement cam that selectively engages a member of the sidewall in order to permit the sidewall to be moved upwardly and downwardly along a vertical direction relative to the rack adjustment assembly.

20 Claims, 9 Drawing Sheets

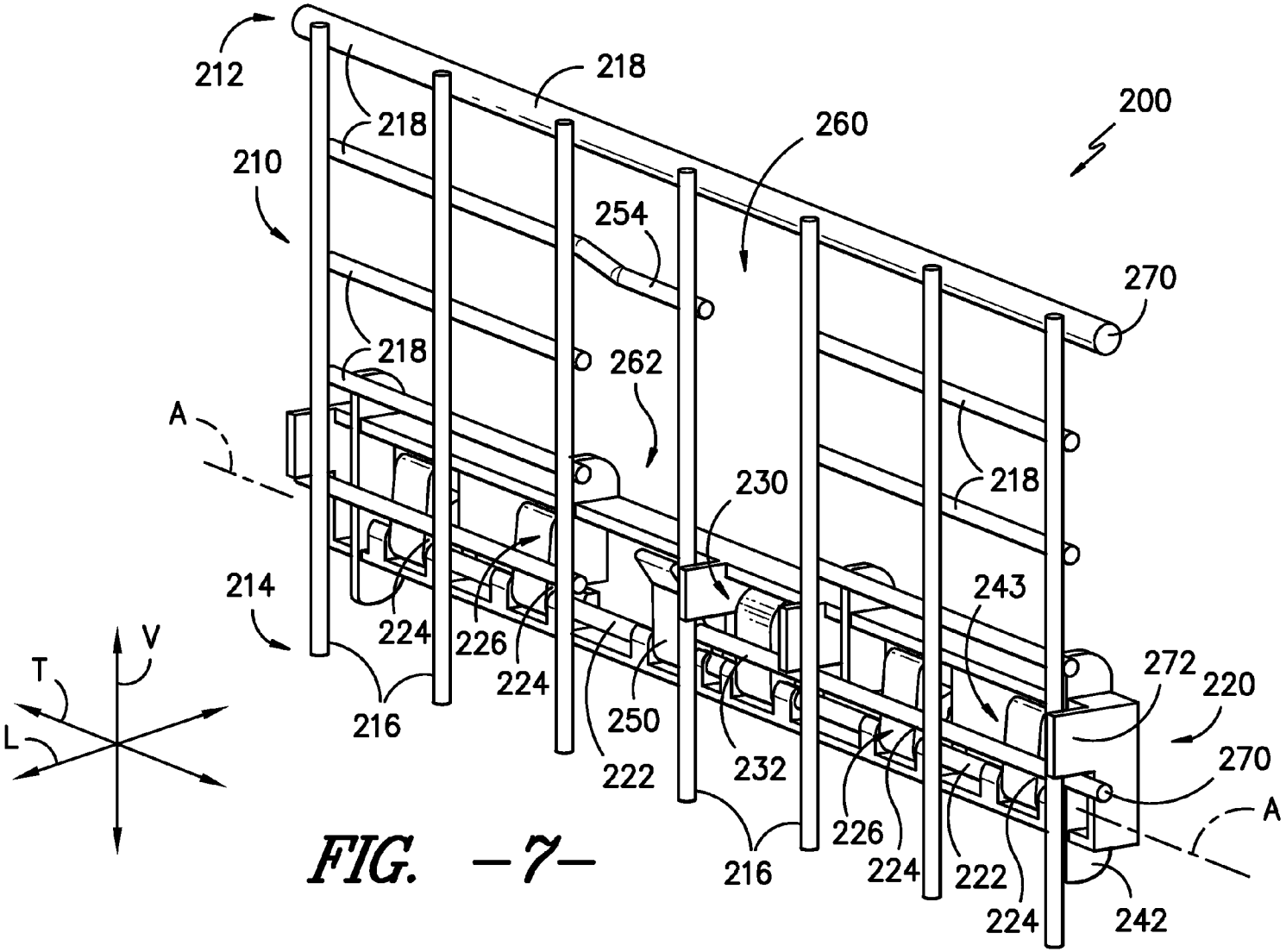
FIG. —7—

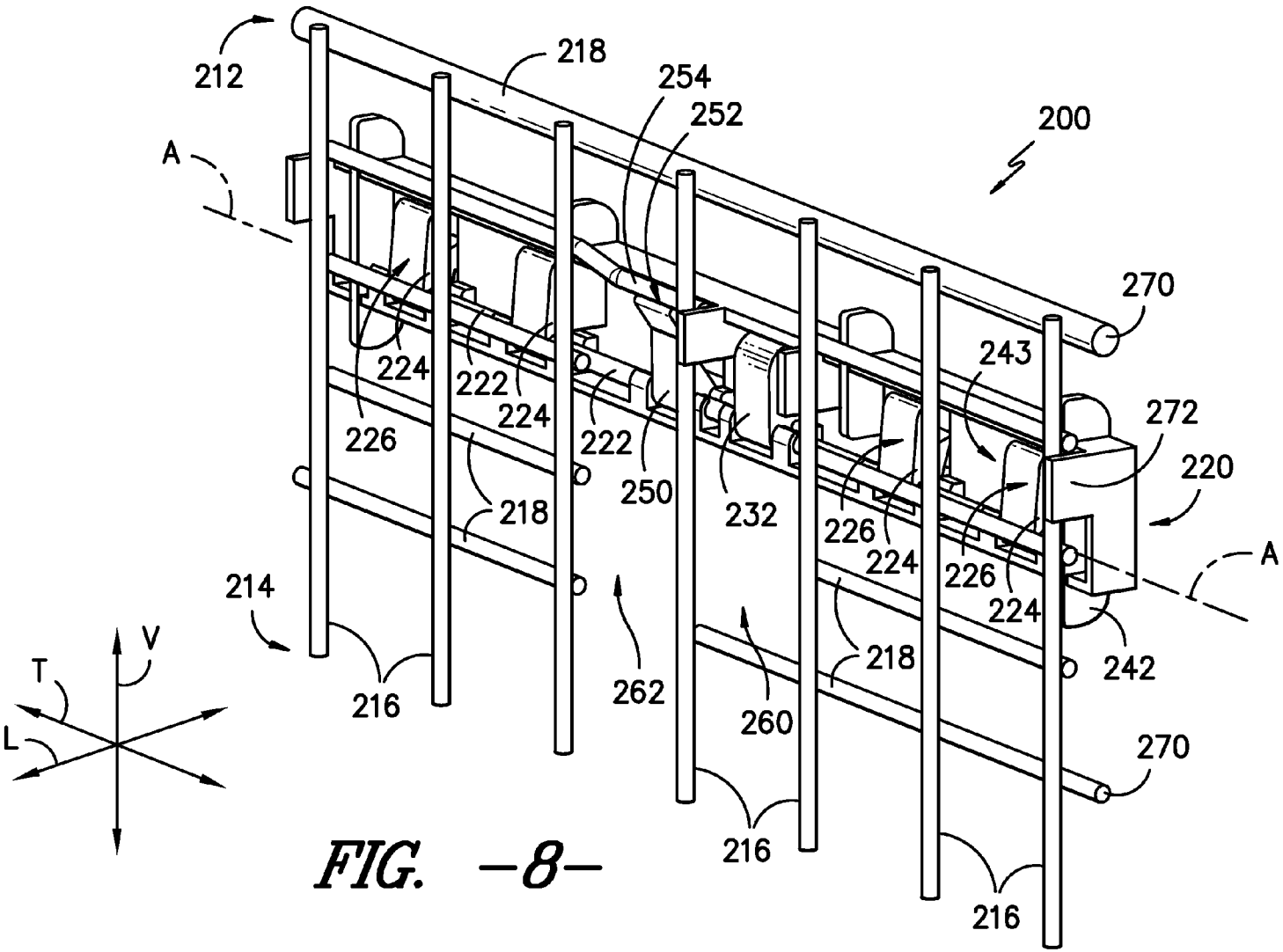
FIG. —8—

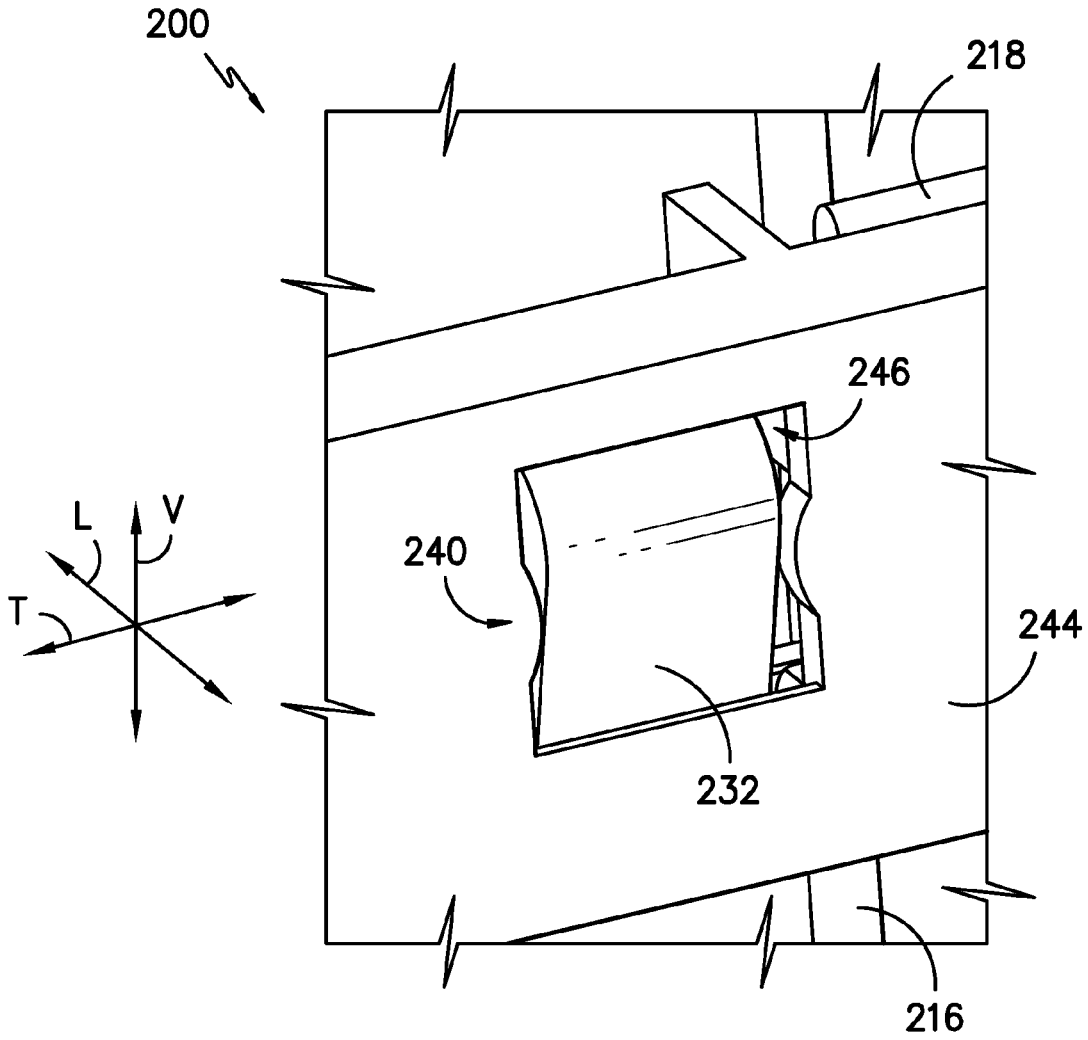
FIG. —9—

HEIGHT ADJUSTMENT MECHANISM FOR RACK ASSEMBLIES OF APPLIANCES

FIELD OF THE INVENTION

The present subject matter relates generally to height adjustment mechanisms for rack assemblies of appliances.

BACKGROUND OF THE INVENTION

A dishwasher appliance is typically provided with one or more rack assemblies into which various articles may be loaded for cleaning. The rack assemblies may include features such as, e.g., tines that hold and orient the articles to receive sprays of wash and rinse fluids during the cleaning process. The articles to be cleaned may include a variety of dishes, cooking utensils, silverware, and other items.

The size of the articles can vary significantly. For example, glasses are available in a variety of different heights. Dishes are manufactured with various diameters between large and small. Pots used for cooking can have different depths.

In order to accommodate the larger articles, an upper rack assembly of a dishwasher appliance can be provided with features for height adjustment of the rack assembly. Such adjustability allows for movement of the upper rack assembly along a vertical direction. By moving or lifting the upper rack to a higher vertical position, larger articles can be accommodated in, e.g., a lower rack assembly positioned beneath the upper rack assembly. Conversely, by lowering the upper rack to a lower vertical position, larger articles can be accommodated in, e.g., the upper rack assembly.

Certain adjustment features have been proposed for providing height adjustability for a rack assembly. Typically, these features include multiple moving parts that may require the user to manipulate both the rack assembly and the adjustment features at the same time when lifting and/or lowering the rack assembly. For example, the user may be required to lower or lift the rack assembly while simultaneously depressing or squeezing a lever or other aspect of the adjustment feature. For certain users, these adjustment features can be difficult to operate.

Accordingly, a rack assembly for an appliance that can be easily adjusted to different vertical positions would be useful. In particular, a rack assembly for an appliance that can be easily adjusted to multiple different vertical positions would be useful.

BRIEF DESCRIPTION OF THE INVENTION

The present subject matter provides a rack assembly for an appliance. The rack assembly includes a sidewall and a rack adjustment assembly. The rack adjustment assembly includes an engagement cam that selectively engages a member of the sidewall in order to permit the sidewall to be moved upwardly and downwardly along a vertical direction relative to the rack adjustment assembly. Additional aspects and advantages of the invention will be set forth in part in the following description, or may be apparent from the description, or may be learned through practice of the invention.

In a first exemplary embodiment, a rack assembly for an appliance is provided. The rack assembly defines a vertical direction and a transverse direction. The vertical and transverse directions being perpendicular. The rack assembly includes a sidewall formed of a series of vertical members fixed to a series of transverse members. The series of vertical members extends longitudinally along the vertical direction and is spaced apart from one another along the transverse direction. The series of transverse members extends longitudinally along the transverse direction and is spaced apart from one another along the vertical direction. A rack adjustment assembly is positioned adjacent the sidewall and includes an axle that has an axis of rotation about which the axle is rotatable. An engagement cam is fixed to the axle and has an upper surface and a lower surface positioned opposite the upper surface. The engagement cam is rotatable with the axle about the axis of rotation between a support position and an adjustment position. In the support position, the upper surface of the engagement cam is in contact with one of the series of transverse members. In the adjustment position, the engagement cam is oriented in a manner that allows one of the series of transverse members to move across the lower surface of the engagement cam.

In a second exemplary embodiment, a rack assembly for an appliance is provided. The rack assembly defines a vertical direction, and a transverse direction. The vertical and transverse directions are perpendicular. The rack assembly includes a sidewall formed of a series of vertical members fixed to a series of transverse members. The series of vertical members extends longitudinally along the vertical direction and is spaced apart from one another along the transverse direction. The series of transverse members extends longitudinally along the transverse direction and is spaced apart from one another along the vertical direction. A rack adjustment is positioned adjacent the sidewall and includes an axle that has an axis of rotation about which the axle is rotatable. An engagement cam is fixed to the axle and is rotatable with the axle about the axis of rotation. The engagement cam is rotatable between a support position and an adjustment position. The engagement cam supporting one of the series of transverse members in the support position in order to hinder the rack assembly from moving downwardly along the vertical direction.

In a third exemplary embodiment, a dishwasher appliance is provided. The dishwasher appliance defines a vertical direction, a lateral direction, and a transverse direction. The vertical, lateral, and transverse directions are mutually perpendicular. The dishwasher appliance includes a tub that defines a wash chamber. The dishwasher appliance also includes a rack assembly for receipt of articles for washing. The rack assembly has opposing sidewalls that are spaced apart along the lateral direction. The opposing sidewalls each have a series of vertical members fixed to a series of transverse members. The series of vertical members extends longitudinally along the vertical direction and is spaced apart from one another along the transverse direction. The series of transverse members extends longitudinally along the transverse direction and is spaced apart from one another along the vertical direction. A pair of slides is mounted to the tub at the opposing sidewalls of the rack assembly. The pair of slides configured for sliding movement of the rack assembly within the wash chamber of the tub. A pair of rack adjustment assemblies is mounted to the pair of slides. Each of the rack adjustment assemblies includes an axle having an axis of rotation about which the axle is rotatable. An engagement cam is fixed to the axle and has an upper surface and a lower surface positioned opposite the upper surface. The engagement cam is rotatable with the axle about the axis of rotation between a support position and an adjustment position. In the support position, the upper surface of the engagement cam is in contact with one of the series of transverse members. In the adjustment position, the engagement cam is oriented in a manner that allows one of the series of transverse members to move across the lower surface of the engagement cam.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIGS. 4-8 illustrate front, perspective views of the sidewall of the rack assembly and the rack adjustment assembly of FIG. 3. A cover of the rack adjustment assembly is removed to reveal engagement cams of the rack adjustment assembly. The engagement cam selectively engages transverse members of the sidewall in order to support the rack assembly and permit vertical movement of the sidewall.

FIG. 9 is a rear, perspective view of the rack adjustment assembly of FIG. 7. A weighted cam of the rack adjustment assembly is received by a locking mechanism of the rack adjustment assembly.

DETAILED DESCRIPTION

Figure 1:
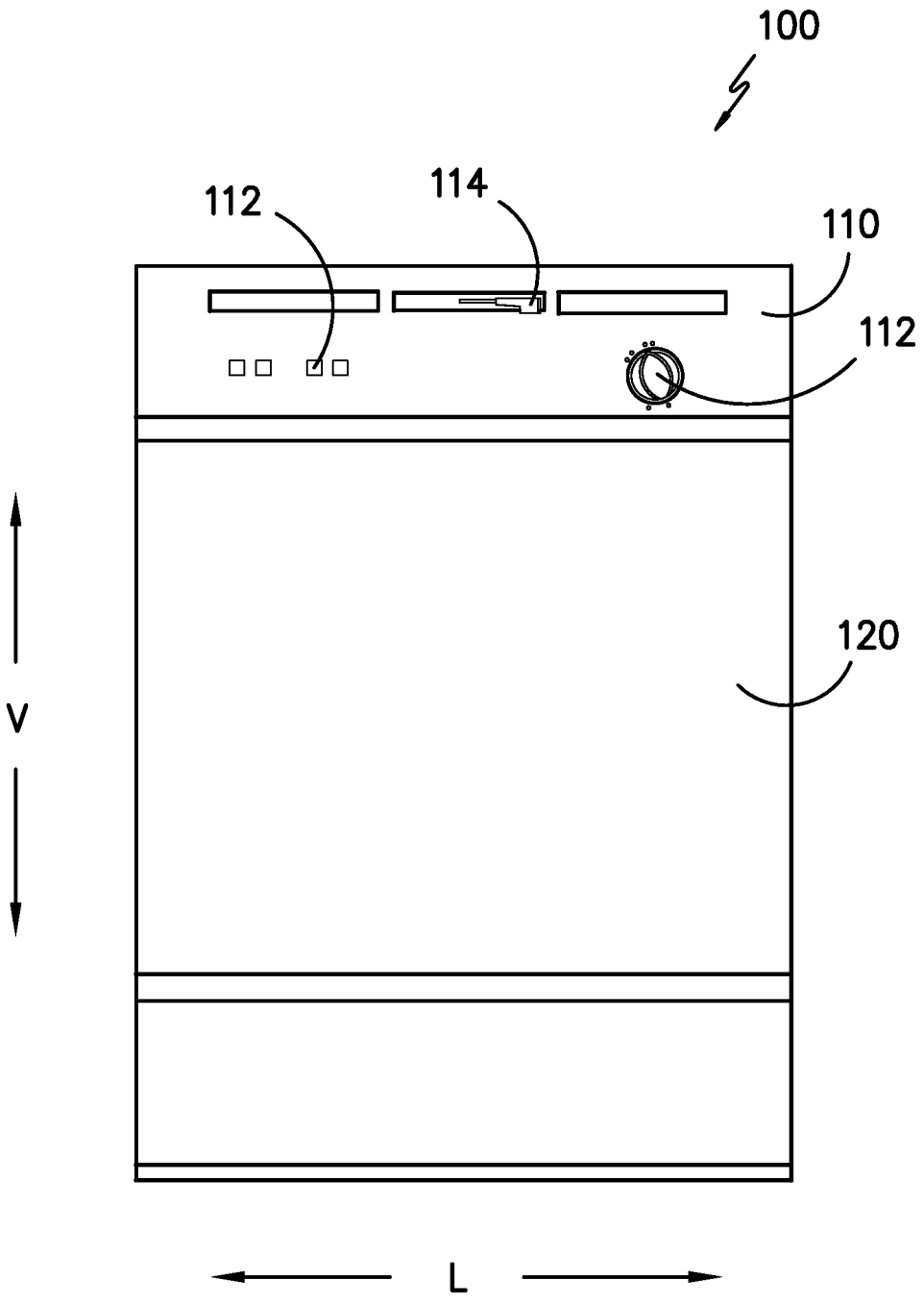
FIG. 1 provides a front view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
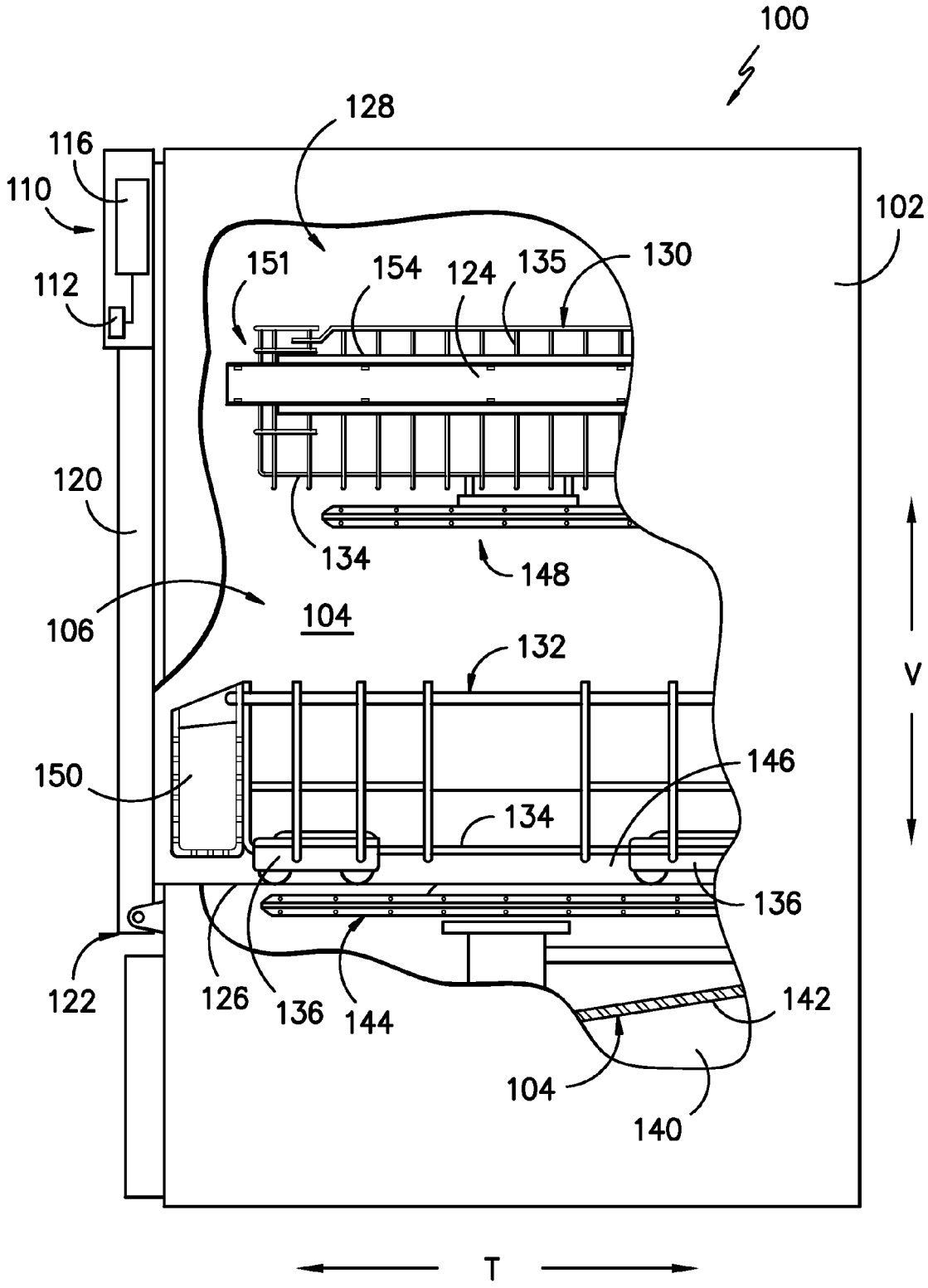
FIG. 2 provides a partial, cross-sectional side view of the dishwasher appliance of FIG. 1.

FIGS. 1 and 2 depict a dishwasher appliance 100 according to an exemplary embodiment of the present subject matter. Dishwasher appliance 100 defines a vertical direction V, a lateral direction L (FIG. 1), and a transverse direction T (FIG. 2). The vertical, lateral, and transverse directions V, L, and T are mutually perpendicular and form an orthogonal direction system.

Dishwasher appliance 100 also includes a cabinet 102 (or chassis) having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from dishwasher appliance 100. Latch 114 is used to lock and unlock door 120 for access to chamber 106.

Slide assemblies 124 are mounted on opposing tub sidewalls 128 to support and provide for movement for an upper rack assembly 130. Lower guides 126 are positioned in opposing manner of the sides of chamber 106 and provide a ridge or shelf for roller assemblies 136 so as to support and provide for movement of lower rack assembly 132. Each of the upper and lower rack assemblies 130, 132 is fabricated into lattice structures including a plurality of elongated members 134 and 135 that extend in lateral (L), transverse (T), and/or vertical (V) directions. Each rack assembly 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry rack assemblies 130 and 132, respectively. A silverware basket 150 may be removably attached to the lower rack assembly 132 for placement of silverware, small utensils, and the like, that are too small to be accommodated by the upper and lower racks 130, 132.

The dishwasher appliance 100 further includes a lower spray assembly 144 that is rotatably mounted within a lower region 146 of the wash chamber 106 and above a tub sump portion 142 so as to rotate in relatively close proximity to the lower rack 132. A mid-level spray assembly 148 is located in an upper region of the wash chamber 106 and may be located in close proximity to upper rack 130. Additionally, an upper spray assembly (not shown) may be located above the upper rack 130.

The lower and mid-level spray assemblies 144, 148 and the upper spray assembly are fed by a fluid circulation assembly for circulating water and wash fluid in the tub 104. Portions of the fluid circulation assembly may be located in a machinery compartment 140 located below the bottom sump portion 142 of the tub 104, as generally recognized in the art. Each spray assembly includes an arrangement of discharge ports or orifices for directing washing liquid onto dishes or other articles located in the upper and lower racks 130, 132, respectively. The arrangement of the discharge ports in at least the lower spray assembly 144 provides a rotational force by virtue of washing fluid flowing through the discharge ports. The resultant rotation of the lower spray assembly 144 provides coverage of dishes and other articles with a washing spray.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface 112 may include a display component, such as a digital or analog display device designed to provide operational feedback to a user. User interface 112 may be in communication with controller 116 via one or more signal lines or shared communication busses.

It should be appreciated that the invention is not limited to any particular style, model, or configuration of dishwasher appliance. Thus, the exemplary embodiment depicted in FIGS. 1 and 2 is for illustrative purposes only. For example, different locations may be provided for a user interface 112, different configurations may be provided for rack assemblies 130 and 132, and other differences may be applied as well.

Dishwasher appliance 100 also includes features for permitting movement of upper rack assembly 130 along the vertical direction V such that upper rack assembly 130 may be placed in various positions along the vertical direction V. In particular, dishwasher appliance 100 includes a rack adjustment mechanism 154 mounted to slide assemblies 124. As an example, a user can utilize rack adjustment mechanism 154 to shift upper rack assembly 130 upwardly or downwardly along the vertical direction V, e.g., relative to tub sump portion 142. Such adjustment can permit larger dishes to be loaded into upper and/or lower rack assemblies 130 and 132.

Figure 3:
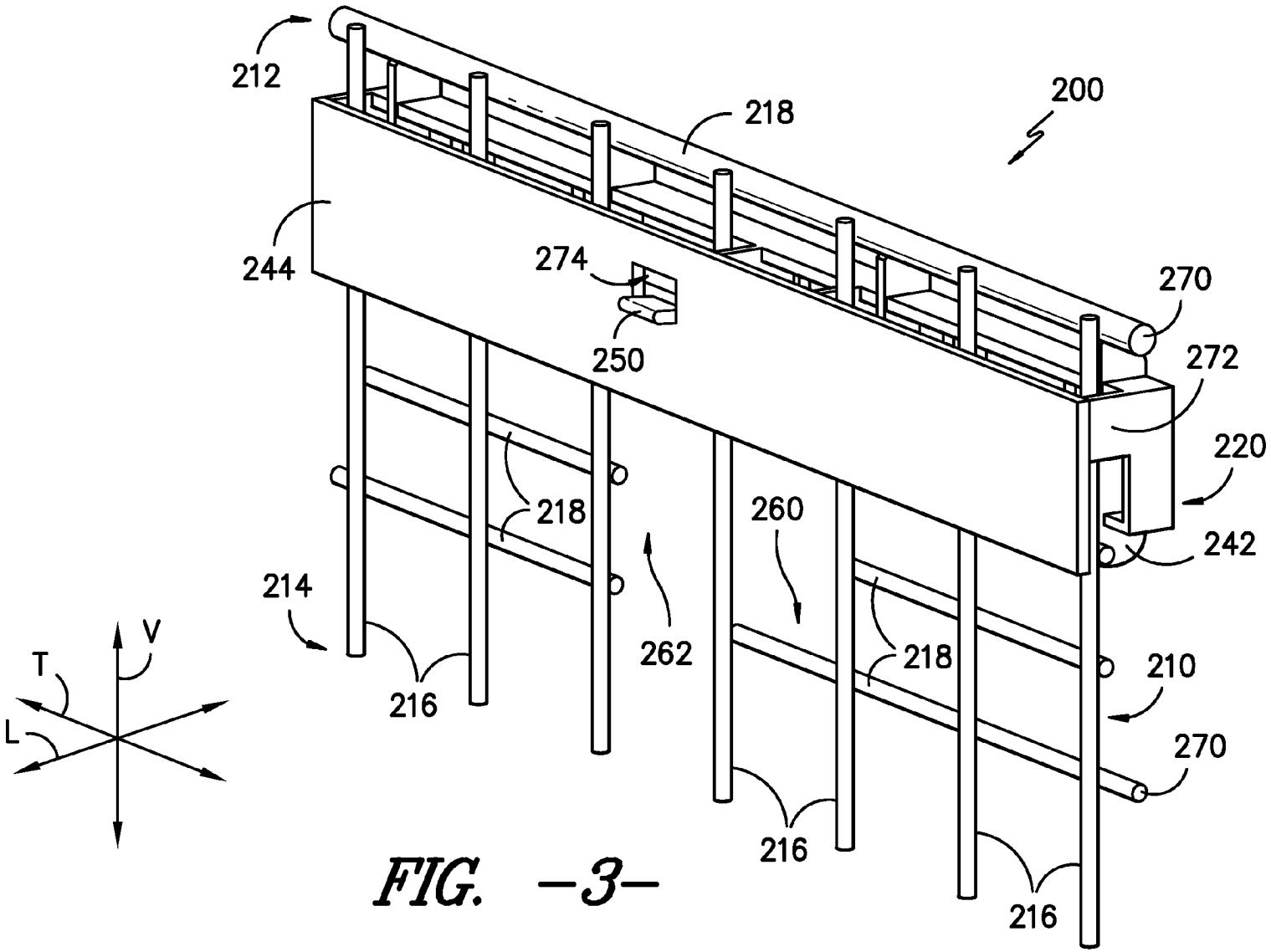
FIG. 3 illustrates a front, perspective view of a sidewall of a rack assembly and a rack adjustment assembly according to exemplary embodiments of the present subject matter.

FIG. 3 illustrates a front, partial perspective view of a rack assembly 200 according to an exemplary embodiment of the present subject matter. As an example, rack assembly 200 may be utilized in dishwasher appliance 100 as upper rack assembly 130 (FIG. 2). Rack assembly 200 may also be used in any other suitable appliance such as a refrigerator appliance.

Rack assembly 200 includes a sidewall 210 and a rack adjustment assembly 220. Sidewall 210 extends between a top potion 212 and a bottom portion 214 along the vertical direction V. Sidewall 210 includes a series of vertical members 216 fixed to a series of transverse members 218. Each vertical member of series of vertical members 216 extends longitudinally along the vertical direction V. Vertical members of the series of vertical members 216 are also spaced apart from one another along the transverse direction T. Similarly, each transverse member of series of transverse members 218 extends longitudinally along the transverse direction T. Transverse members of series of transverse members 218 are also spaced apart from one another along the vertical direction V. Thus, series of vertical members 216 and series of transverse members for a lattice structure for containing articles within rack assembly 200.

Rack adjustment assembly 220 includes features for permitting movement of sidewall 210 along the vertical direction V, e.g., relative to rack adjustment assembly 220. Thus, as an example, a user can pull upwardly on sidewall 210 to shift sidewall 210 upwardly along the vertical direction V. Rack adjustment assembly 220 includes features for supporting sidewall 210 at various locations along the vertical direction V, e.g., when a user pulls on sidewall 210 as discussed in greater detail below.

FIGS. 4-8 illustrate front, perspective views of sidewall 210 and rack adjustment assembly 220. In FIGS. 4-8, a cover 244 (FIG. 3) of rack adjustment assembly 220 is removed to an interior of rack adjustment assembly 220. As shown in FIG. 3, cover 244 is mounted to a casing 242 of rack adjustment assembly 220. Turning back to FIG. 4, casing 242 is slidably mounted to sidewall 210. Casing 242 defines a cavity 243 that receives components of other components of rack adjustment assembly 220.

An axle 222 is mounted to casing 242, e.g., within cavity 243. Axle 222 extends longitudinally along the transverse direction T. Axle 222 also has an axis of rotation A about which axle 222 is rotatable. Thus, axle 222 is rotatable mounted to casing 242. In alternative exemplary embodiments, rack adjustment assembly 220 may include a plurality of axles rather than a single axle as shown in FIG. 4.

A plurality of engagement cams 224 are mounted or fixed to axle 222. Thus, engagement cams 224 can rotate with axle 222 when axle 222 rotates about axis or rotation A. Engagement cams 224 each have an upper surface 228 and a lower surface 226. Upper surface 228 is positioned opposite upper surface 226 on engagement cams 224. Upper surface 228 includes a groove for receipt of one of series of transverse members 216 of sidewall 210 as discussed in greater detail below.

Engagement cams 224 are configured for hindering sidewall 210 from moving downwardly along the vertical direction V when one of series of transverse members 216 is positioned on or engages upper surface 228 of engagement cams 224. Conversely, engagement cams 224 are configured for permitting sidewall 210 to move upwardly along the vertical direction V when one of series of transverse members 216 is positioned on, impacts, or engages lower surface 226 of engagement cams 224. Thus, engagement cams 224 permit movement of sidewall 210 along the vertical direction V, e.g., relative to rack adjustment assembly 220. In particular, engagement cams 224 permit selective positioning of sidewall 210 along the vertical direction V.

Figure 4:
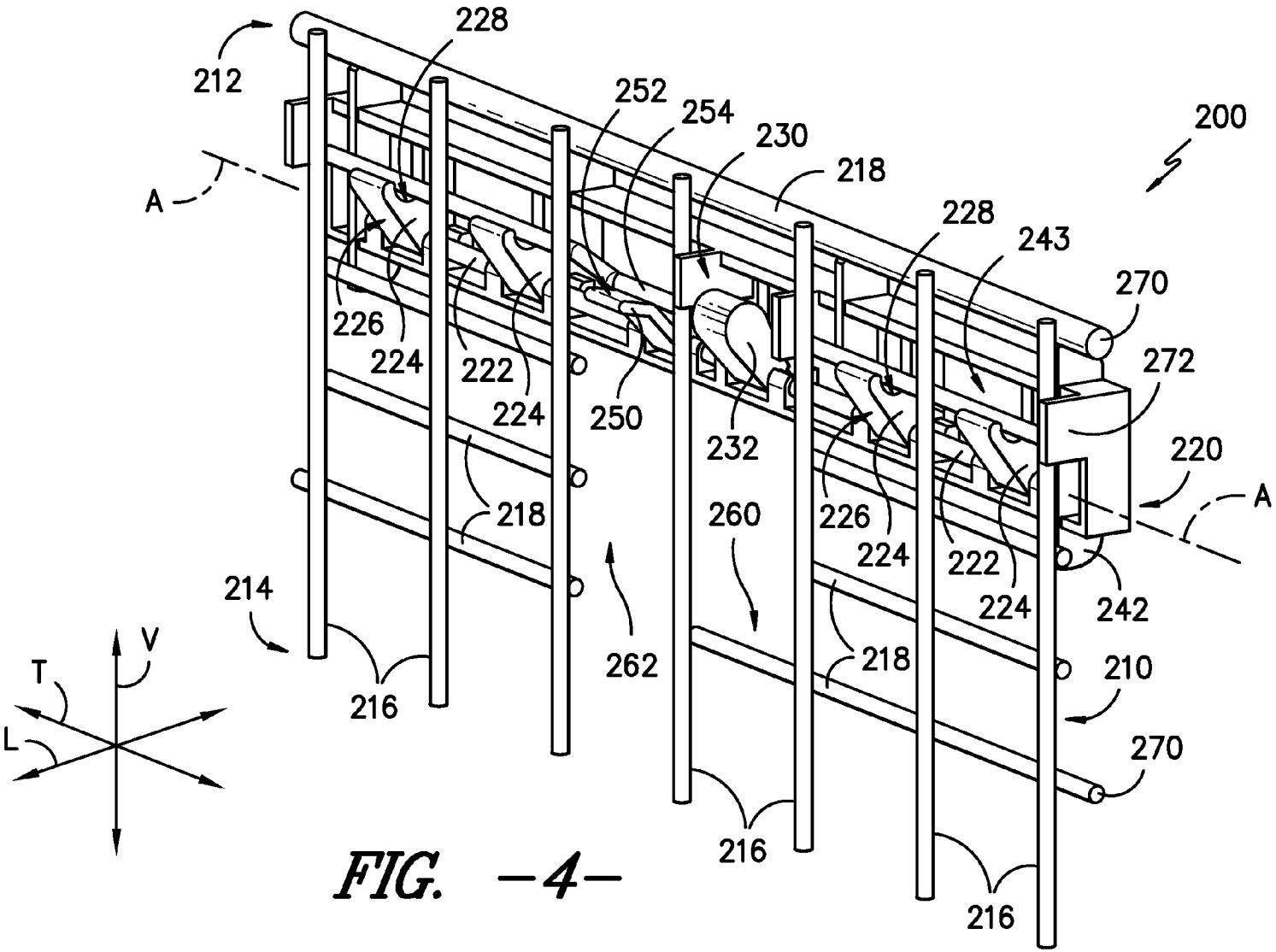

As an example, turning to FIG. 4, rack adjustment assembly 220 is shown in a first or support position in which engagement cams 224 support sidewall 210 at top portion 212 of sidewall 210. In particular, one of series of transverse members 216 at top portion 212 of sidewall 210 is positioned on upper surface 228 of engagement cams 224 within the groove of upper surface 228 such that sidewall 210 sits on and hangs from engagement cams 224.

However, a user may prefer for sidewall 210 to be positioned higher along the vertical direction V. To adjust rack assembly, the user can grasp sidewall 210 and pull upwardly on sidewall 210 along the vertical direction V. The transverse member of series of transverse members 216 will lift off upper surface 228 of engagement cams 224. Further, turning now to FIG. 5, as the user continues to lift sidewall 210 upwardly, one of series of transverse members 216 will impact lower surface 226 of engagement cams 224 and the transverse member will slide on lower surface 226 of engagement cams 224 causing engagement cams 224 to rotate towards a second or adjustment position, e.g., within cavity 243 of casing 242. Thus, series of transverse members 216 can rest on engagement cams 224 when engagement cams 224 are in the first position. Conversely, series of transverse members 216 can slide past engagement cams 224 when engagement cams 224 are in the second position.

Rack adjustment assembly 220 also includes a biasing element 230 that urges engagement cams 224 towards the first position. In the exemplary embodiment shown in FIGS. 4-8, biasing element 230 includes a weighted cam 232 that is mounted or fixed to axle 222. Weighted cam 232 is configured for urging engagement cams 224 from the second position to the first position. However, in alternative exemplary embodiments, biasing element 230 may include any suitable mechanism for urging engagement cams 224 towards the first position such as a torsion spring.

Figure 5:
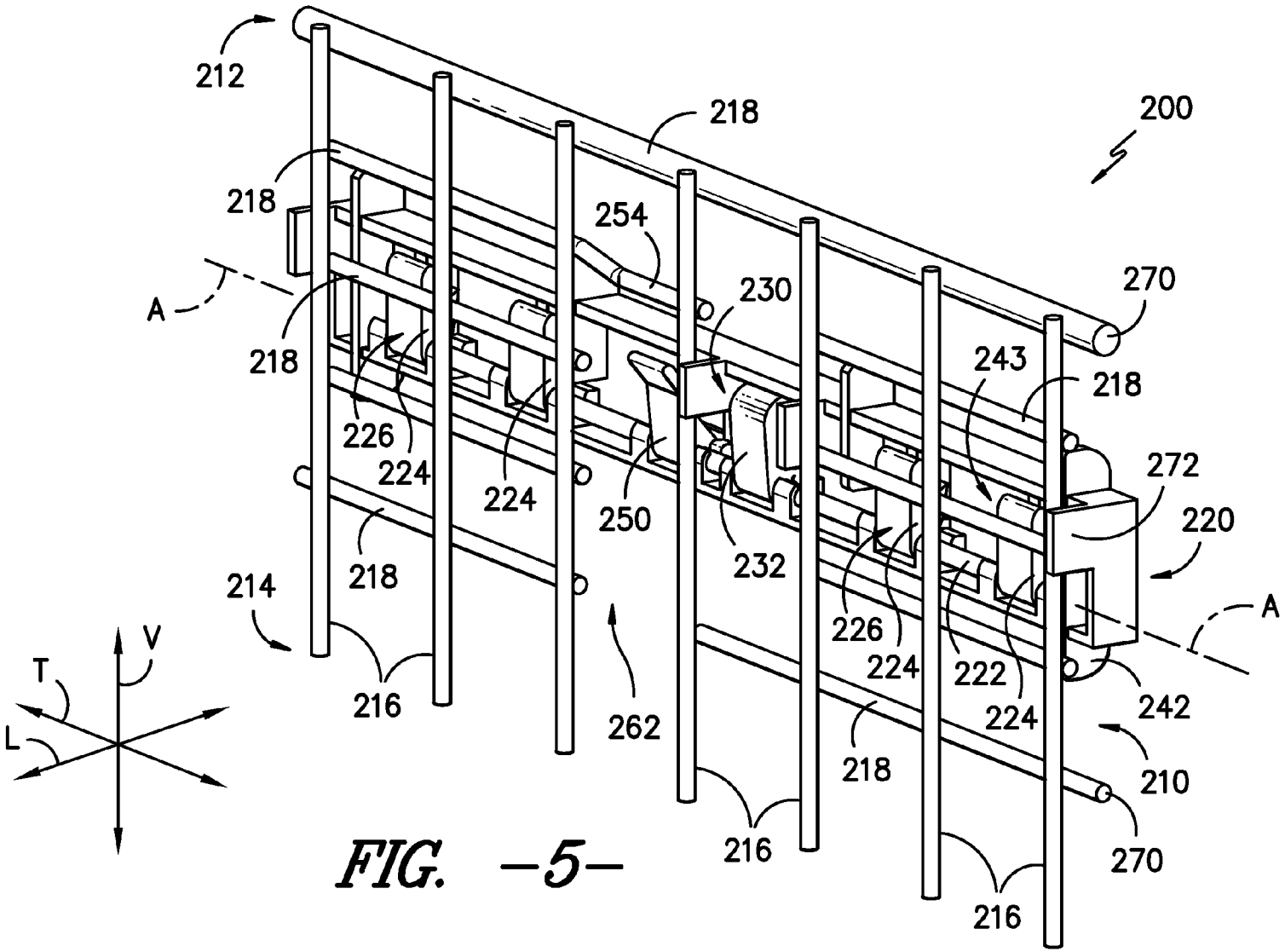
Figure 6:
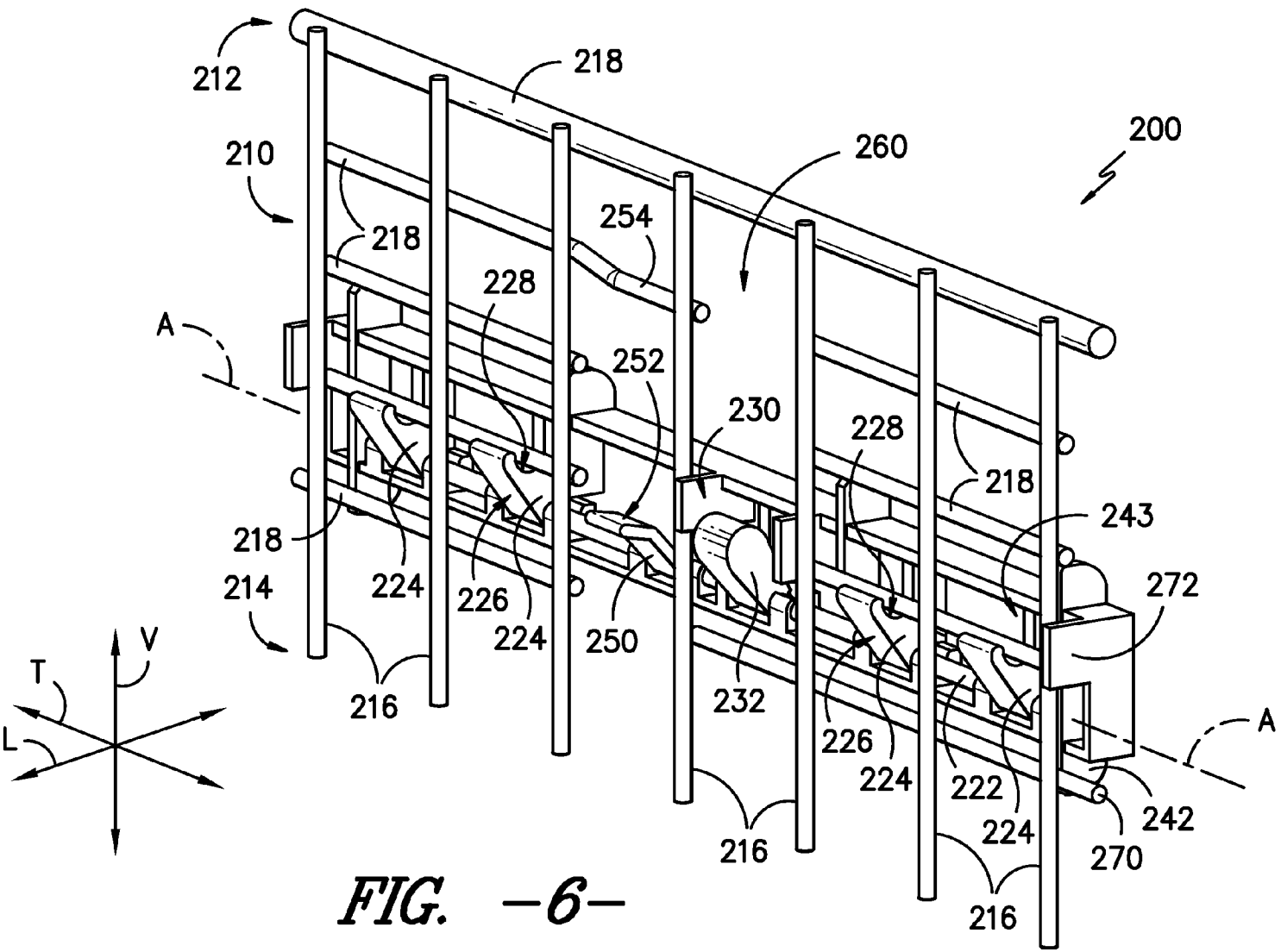

As an example, as shown in FIG. 5, one of series of transverse members 216 is positioned on lower surface 226 of engagement cams 224. A user can lift upwardly on sidewall 210 until the transverse member slides off lower surface 226 of engagement cams 224. In turn, gravity acting on weighted cam 232 will urge engagement cams 224 to the first position as shown in FIG. 6. The user may then permit sidewall 210 to drop downwardly along the vertical direction V until one of series of transverse members 216, e.g., at bottom portion 214 of sidewall 210, is positioned on upper surface 228 of engagement cams 224 within the groove of upper surface 228 such that sidewall 210 sits on and hangs from engagement cams 224. In such a manner, rack adjustment assembly 220 can permit a user to move sidewall upwardly along the vertical direction V, e.g., relative to rack adjustment assembly 220.

However, a user can also move sidewall 210 downwardly along the vertical direction V from the position shown in FIG. 6, e.g., relative to rack adjustment assembly 220. Rack adjustment assembly 220 includes a locking mechanism 240 (FIG. 9) for receiving weighted cam 232 and securing engagement cams 224 in the second position. FIG. 9 is a rear, perspective view of rack adjustment assembly 200 with weighted cam 232 received by locking mechanism 240. In particular, locking mechanism 240 includes an aperture 246 defined by cover 244. Weighted cam 232 is received by aperture 246 in order to secure engagement cams 224 in the second position as discussed in greater detail below.

As discussed above, a user can move sidewall 210 downwardly along the vertical direction V, e.g., relative to rack adjustment assembly 220. As an example, from the configuration shown in FIG. 6, a user can pull upwardly on sidewall 210 until weighted cam 232 is urged against one of series of transverse members 216 at bottom portion 214 of sidewall 210 as shown in FIG. 7. When weighted cam 232 engages the transverse member, weighted cam 232 is rotated into and secured within aperture 246 (FIG. 9) of locking mechanism 240 (FIG. 9). With weighted cam 232 held by locking mechanism 240, engagement cams 224 are position out of the way of series of transverse members 216 in the second position. Accordingly, sidewall 210 can shift downwardly along the vertical direction V without series of transverse members 216 impacting upper surface 228 of engagement cams 224.

To secure sidewall 210 at top portion 212 of sidewall 210, weighted cam 242 is removed from locking mechanism 240 in order to permit engagement cams 224 to rotate to the first position and engage series of transverse members 216. In particular, as shown in FIG. 8, a resetting member 250 fixed to axle 222 is urged against a projection 254 formed with one of series of transverse members 216 positioned at top portion 212 of sidewall 210. Thus, a top surface 252 of resetting member 250 impacts projection 254, and, because both resetting member 262 and weighted cam 232 are fixed to axle 222, weighted cam 232 rotates out of locking mechanism 240. If urging resetting member 250 against projection 254 is insufficient to rotate weighted cam 232 out of locking mechanism 240, the user can reach through an opening 274 (FIG. 3) defined in cover 244 (FIG. 3) to manually rotate resetting member 240 such that weighted cam 232 rotates out of locking mechanism 240.

With weighted cam removed from locking mechanism 240, weighted cam 232 urges engagement cams 224 to the first position, and the user can let sidewall 210 drop downwardly until one of series of transverse members 216 at top portion 212 of sidewall 210 is positioned on upper surface 228 of engagement cams 224 such that sidewall 210 sits on and hangs from engagement cams 224 as shown in FIG. 4.

Accordingly, as shown in the examples provided above, rack adjustment assembly 220 permits positioning of sidewall 210 in various positions along the vertical direction V by simply pulling on sidewall 210.

To hinder sidewall 210 from over shifting along the vertical direction V, rack assembly 200 includes stops 270 mounted to sidewall 210 and guides 272 mounted to rack adjustment mechanism 220. In the exemplary embodiment shown in FIG. 4, stops 270 are formed from one of series of transverse members 218. Guides 272 impact stops 270 at top portion 212 and bottom portion 214 of sidewall 210, e.g., in order to hinder sidewall 210 from separating from rack adjustment assembly 220. Thus, stops 270 and guides 272 limit the travel of sidewall 210 along the vertical direction V.

As shown in FIGS. 4-8, series of transverse members 218 and series of vertical members 216 define a weighted cam channel 260 and a resetting member channel 262. Weighted cam channel 260 is configured such that weighted cam 232 only impacts series of transverse members 218 at bottom portion 214 of sidewall 210. Conversely, resetting member channel 262 is configured such that resetting member 250 only impacts series of transverse members 218 at top portion 212 of sidewall 210

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A rack assembly for an appliance, the rack assembly defining a vertical direction and a transverse direction, the vertical and transverse directions being perpendicular, the rack assembly comprising:

a sidewall formed of a series of vertical members fixed to a series of transverse members, said series of vertical members extending longitudinally along the vertical direction and spaced apart from one another along the transverse direction, said series of transverse members extending longitudinally along the transverse direction and spaced apart from one another along the vertical direction; and a rack adjustment assembly comprising:

an axle having an axis of rotation about which said axle is rotatable;

a plurality of engagement cams fixed to said axle, said plurality of engagement cams spaced from each other along the transverse direction on said axle such that each engagement cam of said plurality of engagement cams is disposed between vertical members of said series of vertical members, each engagement cam of said plurality of engagement cams having an upper surface and a lower surface positioned opposite the upper surface, said plurality of engagement cams being simultaneously rotatable with said axle about the axis of rotation between a support position and an adjustment position, wherein the upper surface of said engagement cams is in contact with one of said series of transverse members in the support position, wherein said plurality of engagement cams is oriented in a manner that allows one of said series of transverse members to move across the lower surface of said engagement cams in the adjustment position.

2. The rack assembly of claim 1, wherein said rack adjustment assembly further comprises a biasing element that urges said plurality of engagement cams to rotate towards a support position.

3. The rack assembly of claim 2, wherein said biasing member comprises a weighted cam fixed to said axle, said weighted cam urging said plurality of engagement cams to rotate towards the support position.

4. The rack assembly of claim 3, wherein said rack assembly extends between a top portion and a bottom portion along the vertical direction, said rack adjustment assembly further comprising a locking mechanism, the locking mechanism receiving said weighted cam when said weighted cam is urged against one of said series of transverse members at the bottom portion of said rack assembly, said plurality of engagement cams held in an adjustment position when said locking mechanism receives said weighted cam.

5. The rack assembly of claim 4, wherein said rack adjustment assembly further comprises a resetting member fixed to said axle, said resetting member urging said weighted cam out of said locking mechanism when said resetting member is urged against one of said series of transverse members at the top portion of said rack assembly.

6. The rack assembly of claim 1, wherein said series of vertical members are uniformly spaced apart from one another along the transverse direction, and said series of transverse members are uniformly spaced apart from one another along the vertical direction.

7. The rack assembly of claim 1, wherein a vertical position of said sidewall is selectively adjustable with said rack adjustment assembly by pulling said sidewall upwardly along the vertical direction or by pushing said sidewall downwardly along the vertical direction.

8. A rack assembly for an appliance, the rack assembly defining a vertical direction, and a transverse direction, the vertical and transverse directions being perpendicular, the rack assembly comprising:

a sidewall formed of a series of vertical members fixed to a series of transverse members, said series of vertical members extending longitudinally along the vertical direction and spaced apart from one another along the transverse direction, said series of transverse members extending longitudinally along the transverse direction and spaced apart from one another along the vertical direction; and a rack adjustment assembly positioned adjacent said sidewall, said rack adjustment assembly comprising:

an axle having an axis of rotation about which said axle is rotatable;

an plurality of engagement cams fixed to said axle, said plurality of engagement cams spaced from each other along the transverse direction on said axle such that each engagement cam of said plurality of engagement cams is disposed between vertical members of said series of vertical members, said plurality of engagement cams simultaneously rotatable with said axle about the axis of rotation;

wherein said plurality of engagement cams is rotatable between a support position and an adjustment position, said plurality of engagement cams supporting one of said series of transverse members in the support position in order to hinder said rack assembly from moving downwardly along the vertical direction.

9. The rack assembly of claim 8, wherein said rack adjustment assembly further comprises a biasing element that urges said plurality of engagement cams to rotate towards the support position.

10. The rack assembly of claim 9, wherein said biasing member comprises a weighted cam fixed to said axle, said weighted cam urging said plurality of engagement cams to rotate towards the support position.

11. The rack assembly of claim 9, wherein said rack assembly extends between a top portion and a bottom portion along the vertical direction, said rack adjustment assembly further comprising a locking mechanism, the locking mechanism receiving said weighted cam when said weighted cam is urged against one of said series of transverse members at the bottom portion of said rack assembly, said plurality of engagement cams held in the adjustment position when said locking mechanism receives said weighted cam.

12. The rack assembly of claim 11, wherein said rack adjustment assembly further comprises a resetting member fixed to said axle, said resetting member urging said weighted cam out of said locking mechanism when said resetting member is urged against one of said series of transverse members at the top portion of said rack assembly.

13. The rack assembly of claim 8, wherein said series of vertical members are uniformly spaced apart from one another along the transverse direction, and said series of transverse members are uniformly spaced apart from one another along the vertical direction.

14. The rack assembly of claim 8, wherein a vertical position of said sidewall is selectively adjustable with said rack adjustment assembly by pulling said sidewall upwardly along the vertical direction or by pushing said sidewall downwardly along the vertical direction.

15. A dishwasher appliance, the dishwasher appliance defining a vertical direction, a lateral direction, and a transverse direction, the vertical, lateral, and transverse directions being mutually perpendicular, the dishwasher appliance comprising:

a tub that defines a wash chamber; and a rack assembly for receipt of articles for washing, said rack assembly having opposing sidewalls that are spaced apart along the lateral direction, the opposing sidewalls each having a series of vertical members fixed to a series of transverse members, said series of vertical members extending longitudinally along the vertical direction and spaced apart from one another along the transverse direction, said series of transverse members extending longitudinally along the transverse direction and spaced apart from one another along the vertical direction;

a pair of slides mounted to said tub at the opposing sidewalls of said rack assembly, said pair of slides configured for sliding movement of said rack assembly within the wash chamber of said tub; and a pair of rack adjustment assemblies mounted to said pair of slides, each of said rack adjustment assemblies comprising:

an axle having an axis of rotation about which said axle is rotatable;

a plurality of engagement cams fixed to said axle, said plurality of engagement cams spaced from each other along the transverse direction on said axle such that each engagement cam of said plurality of engagement cams is disposed between vertical members of said series of vertical members, each engagement cam of said plurality of engagement cams having an upper surface and a lower surface positioned opposite the upper surface, said plurality of engagement cams being simultaneously rotatable with said axle about the axis of rotation between a support position and an adjustment position, wherein the upper surface of said engagement cams is in contact with one of said series of transverse members in the support position, wherein said plurality of engagement cams is oriented in a manner that allows one of said series of transverse members to move across the lower surface of said engagement cams in the adjustment position.

16. The dishwasher appliance of claim 15, wherein said rack adjustment assembly further comprises a biasing element that urges said plurality of engagement cams to rotate towards the support position.

17. The dishwasher appliance of claim 16, wherein said biasing member comprises a weighted cam fixed to said axle, said weighted cam urging said plurality of engagement cams to rotate towards the support position.

18. The dishwasher appliance of claim 17, wherein said rack assembly extends between a top portion and a bottom portion along the vertical direction, said rack adjustment assembly further comprising a locking mechanism, the locking mechanism receiving said weighted cam when said weighted cam is urged against one of said series of transverse members at the bottom portion of said rack assembly, said plurality of engagement cams held in the adjustment position when said locking mechanism receives said weighted cam.

19. The dishwasher appliance of claim 18, wherein said rack adjustment assembly further comprises a resetting member fixed to said axle, said resetting member urging said weighted cam out of said locking mechanism when said resetting member is urged against one of said series of transverse members at the top portion of said rack assembly.

20. The dishwasher appliance of claim 15, wherein a vertical position of said tub is selectively adjustable with said pair of rack adjustment assemblies by pulling said tub upwardly along the vertical direction or by pushing said tub downwardly along the vertical direction.

* * * * *